US011187506B1

(12) United States Patent
Merems

(10) Patent No.: US 11,187,506 B1
(45) Date of Patent: Nov. 30, 2021

(54) METHOD FOR FIN DEPLOYMENT USING GUN GAS PRESSURE

(71) Applicant: Raytheon Company, Waltham, MA (US)

(72) Inventor: Paul A. Merems, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/939,865

(22) Filed: Jul. 27, 2020

(51) Int. Cl.
*F42B 10/20* (2006.01)

(52) U.S. Cl.
CPC ..... *F42B 10/20* (2013.01)

(58) Field of Classification Search
CPC ..... F42B 10/20
See application file for complete search history.

(56) References Cited

U.S. PATENT DOCUMENTS 4,607,810 A * 8/1986 Frazer ..... F42B 10/16 206/497
6,695,252 B1 * 2/2004 Dryer ..... F42B 10/14 244/3.28
6,880,780 B1 * 4/2005 Perry ..... F42B 10/14 244/3.27
7,004,425 B2 * 2/2006 Okada ..... F42B 10/16 244/3.29
8,253,085 B1 8/2012 Lichtenberg-Scanlan et al.
8,367,993 B2 * 2/2013 Velez ..... F42B 10/48 244/3.28
9,086,259 B2 * 7/2015 Cleveland ..... F42B 10/20
2012/0048993 A1 * 3/2012 Velez ..... F42B 10/16 244/3.28
2013/0277494 A1 * 10/2013 Rastegar ..... F42B 10/18 244/3.24

OTHER PUBLICATIONS

Pending claims of co-pending U.S. Appl. No. 16/840,817, filed Apr. 6, 2020.

* cited by examiner

*Primary Examiner* — Justin M Benedik
(74) *Attorney, Agent, or Firm* — Renner, Otto, Boisselle & Sklar, LLP

(57) ABSTRACT

A projectile and method of deploying a projectile includes a gun-launched projectile having a pressure reservoir that is fluidly connected to an ejection piston and fin deployment pistons. The fin deployment pistons are actuatable to engage deployable fins of the projectile to move the fins from a folded position to a deployed position. Gas pressure is generated by an external burning propellant to pressurize the pressure reservoir that retains the gas until a muzzle exit of the projectile. When the projectile exits the barrel, the reservoir gas expands thereby causing movement of the ejection piston. When a trailing end of the piston moves past fin deployment piston ports, the remaining reservoir gas pressure acts on the fin deployment pistons which subsequently push on the fins. The fins rotate toward the deployed position in which the fins are locked before the ejection piston is fully ejected.

20 Claims, 7 Drawing Sheets

METHOD FOR FIN DEPLOYMENT USING GUN GAS PRESSURE

FIELD OF THE INVENTION

The invention relates to munitions, more particularly, to tube-launched or gun-launched projectiles and methods of deploying projectiles.

DESCRIPTION OF THE RELATED ART

Projectiles that are launched by guns or tubes may be suitable for different applications. For example, military applications that use munitions may be a suitable application. The projectiles include fins to increase the stability of the projectile during and after deployment of the projectile from the gun or tube. The projectile is fired from a muzzle or barrel of the gun by way of a propellant gas filling a reservoir with pressure to actuate a piston of the projectile. The piston then imparts a force on the fins that causes rotation of the fins out of a folded position. The contact between the piston and the fins is brief and only over a few degrees of rotation of the fins.

When the piston is disengaged from the fins, the fins act against drag and friction from the external environment as the fins continue to rotate toward into the deployed position. In certain applications, the conditions of the external environment are not known or may change due to muzzle velocity, obturator leakage, or other factors. Conventional gun-launched projectiles may be deficient in that the fins are susceptible to stalling and failing to deploy when the projectile encounters the external environment and the contact between the piston and the fin has ended.

One prior attempt to improve fin deployment includes using springs that engage the fins during deployment. However, using springs may be deficient in that the springs do not have the requisite strength to move the fins into the deployed position.

SUMMARY OF THE INVENTION

The present application provides a projectile and method of deploying a projectile that ensures successful deployment of the projectile regardless of an external environment for the projectile. According to a general embodiment, the projectile is a gun-launched projectile including a pressure reservoir that is fluidly connected to an ejection piston and a plurality of fin deployment pistons. The fin deployment pistons are actuatable to engage deployable fins of the projectile and move the fins from a folded position to a deployed position. Gas pressure is generated by an external burning propellant to pressurize the pressure reservoir which retains the gas until a muzzle exit of the projectile from a barrel. When the projectile exits the barrel, the reservoir gas expands thereby causing movement of the ejection piston. The ejection piston acts as a sliding valve such that, when a trailing end of the piston moves past fin deployment piston ports fluidly connected between the pressure reservoir and chambers in which the fin deployment pistons are arranged, the remaining reservoir gas pressure acts on the fin deployment pistons. The fin deployment pistons then start to push on the fins. The fins are thus rotated toward the deployed position in which the fins are locked before the ejection piston is ejected from the projectile assembly.

The fins are locked in an initial deployed position after a predetermined amount of rotation by spring-biased locking pins that are biased against the fins. The fins each may be formed to have a notch that receives a corresponding locking pin after the predetermined amount of rotation. When the fins are locked in the initial deployed position, the fins may be configured to further rotate in the same direction, or overrotate by way of the locking pin slightly pivoting within the notch. The contacting engagement between the fins and the fin deployment pistons is maintained for a predetermined amount of the fin movement to ensure that the fins reach the deployed position. Advantageously, the fin deployment pistons use the pressurized reservoir that is also used to move the ejection piston, such that additional springs or other actuation devices are not needed to deploy the fins.

According to an aspect of the invention, a projectile includes fin deployment pistons configured to engage deployable fins.

According to an aspect of the invention, a projectile includes fin deployment pistons and an ejection piston that each are fluidly connected to a pressure reservoir.

According to an aspect of the invention, a projectile includes fin deployment pistons that ensure deployment of fins prior to ejection of an ejection piston from the projectile assembly.

According to an aspect of the invention, a projectile includes a sliding-type ejection piston that is axially translatable to open fin deployment piston ports that are fluidly connected between a pressure reservoir and chambers containing fin deployment pistons.

According to an aspect of the invention, a projectile includes a fin retainer formed integrally with an ejection piston.

According to an aspect of the invention, a projectile is tube-launched or gun-launched by a propellant that burns to generate high pressure gas.

According to an aspect of the invention, a projectile includes a base, a pressure reservoir connected to the base, a plurality of fins rotatably connected to the base and movable from a folded position to a deployed position, a plurality of fin deployment pistons fluidly connected to the pressure reservoir and engageable with the plurality of fin deployment pistons to move the fins toward the deployed position, and an ejection piston fluidly connected to the pressure reservoir and configured to open fluid communication between the plurality of fin deployment pistons and the pressure reservoir when the pressure reservoir is pressurized.

According to an embodiment of any paragraph(s) of this summary, the ejection piston is configured for axial translation through the pressure reservoir when the pressure reservoir is pressurized.

According to an embodiment of any paragraph(s) of this summary, the base includes a plurality of radially extending chambers, each of the plurality of radially extending ports housing one of the plurality of fin deployment pistons.

According to an embodiment of any paragraph(s) of this summary, the base includes a plurality of fin deployment piston ports connected between the pressure reservoir and the plurality of radially extending chambers.

According to an embodiment of any paragraph(s) of this summary, the ejection piston is movable from an initial position in which the ejection piston blocks the plurality of fin deployment piston ports to a deployment position in which the ejection piston is moved past the plurality of fin deployment piston ports to open the plurality of fin deployment piston ports.

According to an embodiment of any paragraph(s) of this summary, the ejection piston includes a retainer that extends radially outwardly to hold the plurality of fins in the folded position.

According to an embodiment of any paragraph(s) of this summary, the retainer is arranged aft relative to the plurality of fin deployment pistons when the plurality of fins are in the folded position.

According to an embodiment of any paragraph(s) of this summary, each of the plurality of fins includes a notch that receives a protrusion of the retainer when the plurality of fins are in the folded position.

According to an embodiment of any paragraph(s) of this summary, the ejection piston remains attached to the base after the plurality of fins are in the deployed position.

According to an embodiment of any paragraph(s) of this summary, the projectile includes a plurality of locking pins that are supported in the base and configured to engage the plurality of fins when the plurality of fins are in the deployed position.

According to an embodiment of any paragraph(s) of this summary, the plurality of fin deployment pistons are arranged aft relative to the plurality of locking pins.

According to an embodiment of any paragraph(s) of this summary, the plurality of fin deployment pistons are arranged to move in a direction that is orthogonal to a direction in which the ejection piston moves.

According to an embodiment of any paragraph(s) of this summary, each of the plurality of fin deployment pistons has a tapered nose that contacts one of the plurality of fins.

According to an embodiment of any paragraph(s) of this summary, the ejection piston includes a flow control component arranged at an aft end of the base.

According to an embodiment of any paragraph(s) of this summary, the projectile includes a propellant and a primer that are arranged externally to the projectile and configured to pressurize the pressure reservoir.

According to an embodiment of any paragraph(s) of this summary, each of the plurality of fin deployment pistons is configured to engage only one of the plurality of fins.

According to another aspect of the invention, a gun-launched projectile assembly includes a barrel, a cartridge that is arranged in the barrel and contains a propellant and a primer, and a projectile releasably arranged in the cartridge, wherein the projectile includes a base, a pressure reservoir connected to the base, a plurality of fins rotatably connected to the base and movable from a folded position to a deployed position, a plurality of fin deployment pistons fluidly connected to the pressure reservoir and engageable with the plurality of fin deployment pistons to move the fins toward the deployed position, and an ejection piston fluidly connected to the pressure reservoir and configured to open fluid communication between the plurality of fin deployment pistons and the pressure reservoir when the pressure reservoir is pressurized.

According to still another aspect of the invention, a method of deploying a projectile includes fluidly connecting an ejection piston and a plurality of fin deployment pistons to a pressure reservoir, pressurizing the pressure reservoir to move the ejection piston, opening a plurality of fin deployment piston ports that are fluidly connected with the pressure reservoir by movement of the ejection piston, actuating the plurality of fin deployment pistons when the fin deployment piston ports are opened, and engaging a plurality of fins with the plurality of fin deployment pistons to rotate the plurality of fins from a folded position toward a deployed position.

According to an embodiment of any paragraph(s) of this summary, the method includes locking the plurality of fins in the deployed position.

According to an embodiment of any paragraph(s) of this summary, the method includes retaining the plurality of fins in the folded position using a retainer formed on the ejection piston.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in munitions and munition deployment systems, such as in tube-launched or gun-launched projectiles. The projectile and method of deploying the projectile described herein may be suitable for use in military applications. Non-lethal applications and non-military applications may also be suitable, such as surveillance systems. The projectile is suitable for deployment in any environment and may be carried on any suitable platform. Exemplary environments include air, space, and sea, and exemplary platforms include aircraft, hypersonic or supersonic vehicles, land vehicles, or watercraft.

Figure 1:
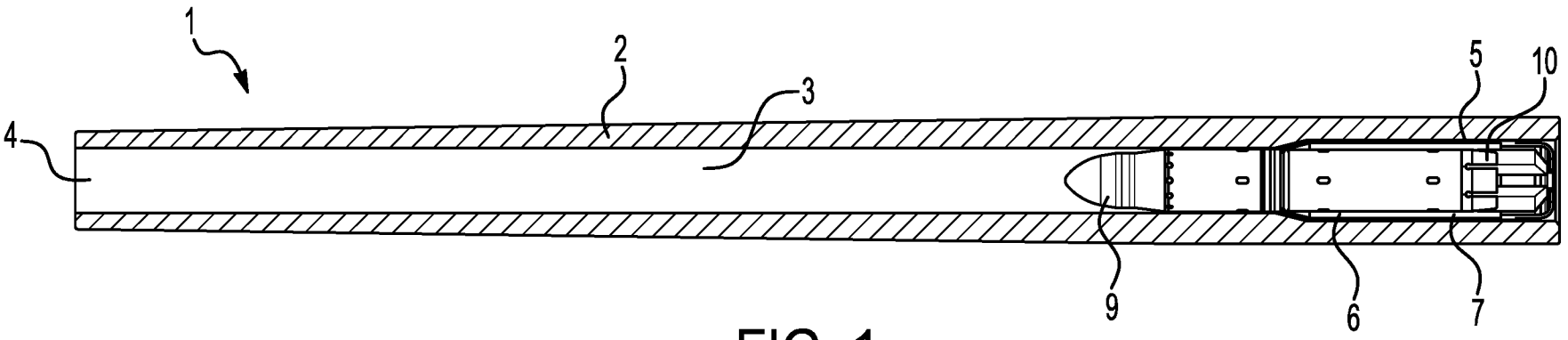
FIG. 1 shows a cross-sectional view of a gun-launched projectile assembly for launching a projectile.
Figure 2:
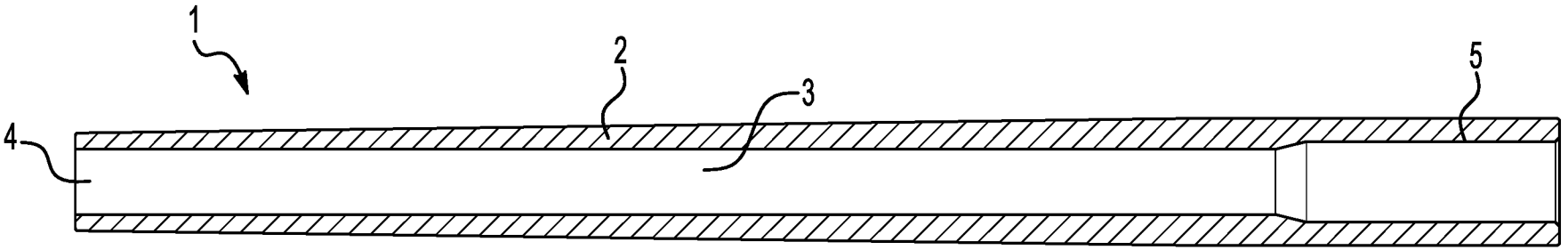
FIG. 2 shows a cross-sectional view of a barrel of the gun-launched projectile assembly of FIG. 1.

Referring first to FIGS. 1 and 2, the projectile described herein may be launched or deployed from a gun 1. The gun 1 includes a barrel 2 that defines a bore 3, a muzzle 4, and a chamber 5 that is arranged opposite to the muzzle 4 and is fluidly connected to the bore 3. The chamber 5 is configured to receive a cartridge 6, as shown in FIG. 1. The cartridge 6 includes a cartridge case 7 and a bullet 8 at a nose end of the cartridge 6.

Figure 3:
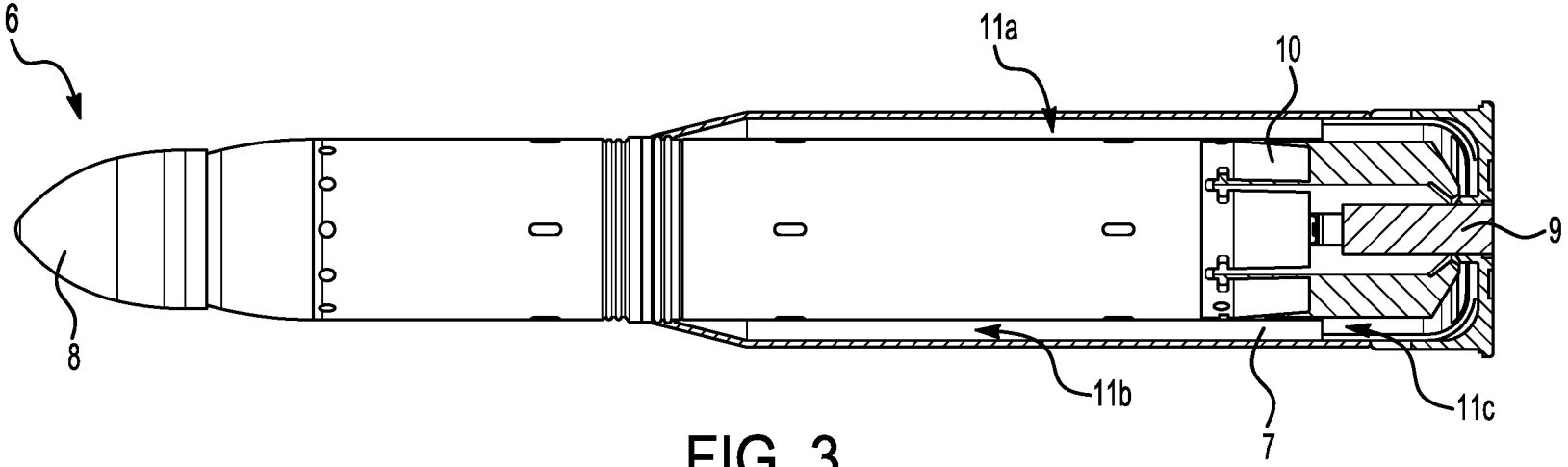
FIG. 3 shows a cross-sectional view of a projectile and cartridge of the gun-launched projectile assembly of FIG. 1.
Figure 4:
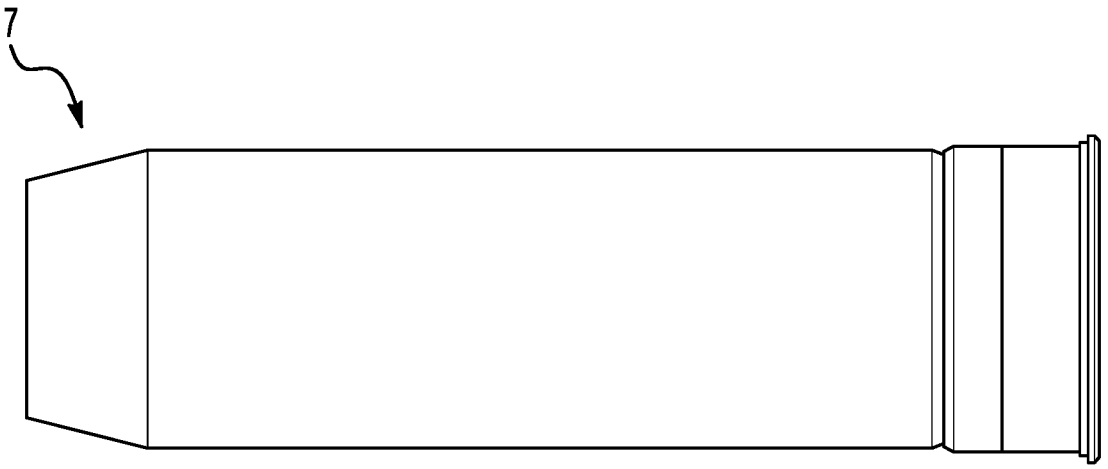
FIG. 4 shows an oblique view of the cartridge of FIG. 3.

Referring in addition to FIGS. 3 and 4, the cartridge case 7 may be cylindrical in shape and is configured to contain a primer 9, a round or projectile 10, and a propellant 11*a*, 11*b*, 11*c*. The projectile 10 is first loaded into the cartridge case 7. The gun 1 may be sized to support any suitable projectile as having any size as required for a particular application. For example, the projectile 10 may have a size as large as 155 millimeters. After insertion of the projectile 10, the propellant 11*a*, 11*b*, 11*c* is then inserted into the cartridge case 7 via a hole in the cartridge case 7 for insertion of the primer 9. The open volume in the cartridge case 7 that surrounds the projectile 10 is filled with the propellant 11*a*, 11*b*, 11*c*. The primer 9, which may be an eclectically initiated primer, is then inserted into the cartridge case 7.

After the cartridge case 7 is assembled, the cartridge 6 is inserted into the chamber 5 of the gun 1, as shown in FIG. 1. The projectile 10 is fired by initiating the primer 9 which causes the propellant 11*a*, 11*b*, 11*c* to burn thereby generating gas. The high pressure gas fills the cartridge case 7 and pushes the projectile 10 from the chamber 5 into the bore 3 of the gun 1. In an exemplary application, the cartridge case 7 may be consumed by the resulting fire from burning the propellant 11*a*, 11*b*, 11*c*. In another exemplary application, the projectile 10 may exit the cartridge case 7 and the chamber 5 at the same time such that the cartridge case 7 is retained in the chamber 5.

As described further below, the high pressure gas will flow through a flow control component on a piston of the projectile 10, such as a restricting orifice or a check valve, into a pressure reservoir of the projectile 10 until the pressures are equal. Upon a muzzle exit by the projectile 10, the differential pressure between the high pressure in the pressure reservoir versus a low ambient pressure of the external environment outside the gun 1 causes the piston to move. In an exemplary embodiment, fasteners that secure the piston to the projectile 10 may be sheared by the pressure differential. In other exemplary embodiments, the projectile 10 may be fired without a case or cartridge. For example, the projectile 10 itself may include a propellant, such as an explosive charge or ignitor contained in the pressure reservoir of the projectile 10.

Figure 5:
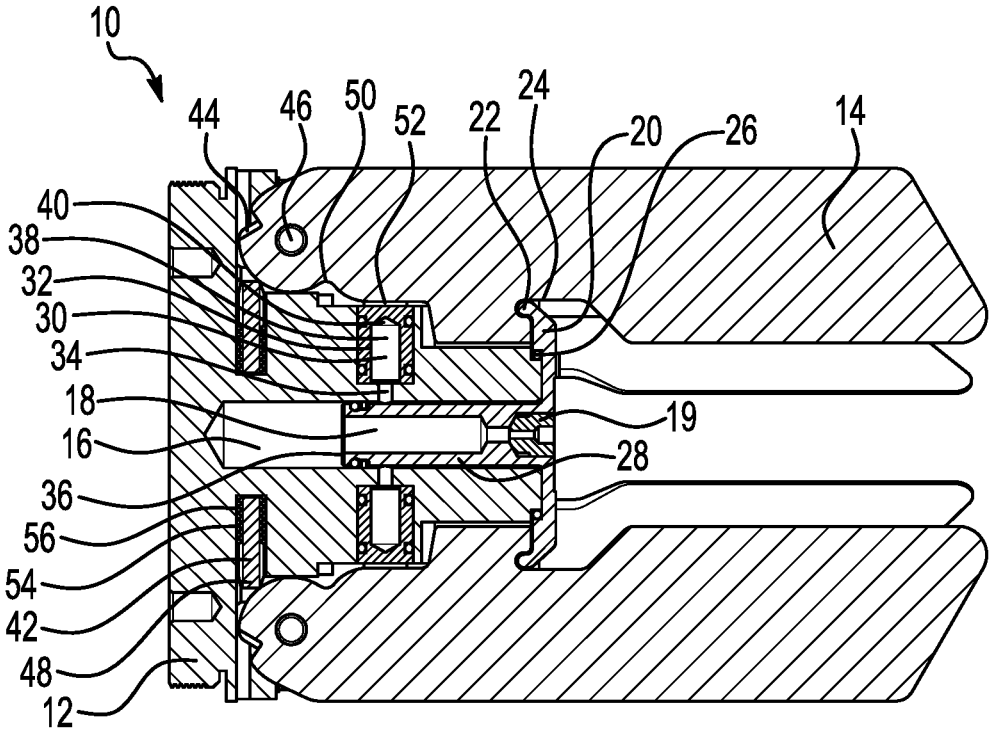
FIG. 5 shows a cross-sectional view of the projectile of FIG. 1 having fins in a folded position and a plurality of fin deployment pistons.
Figure 6:
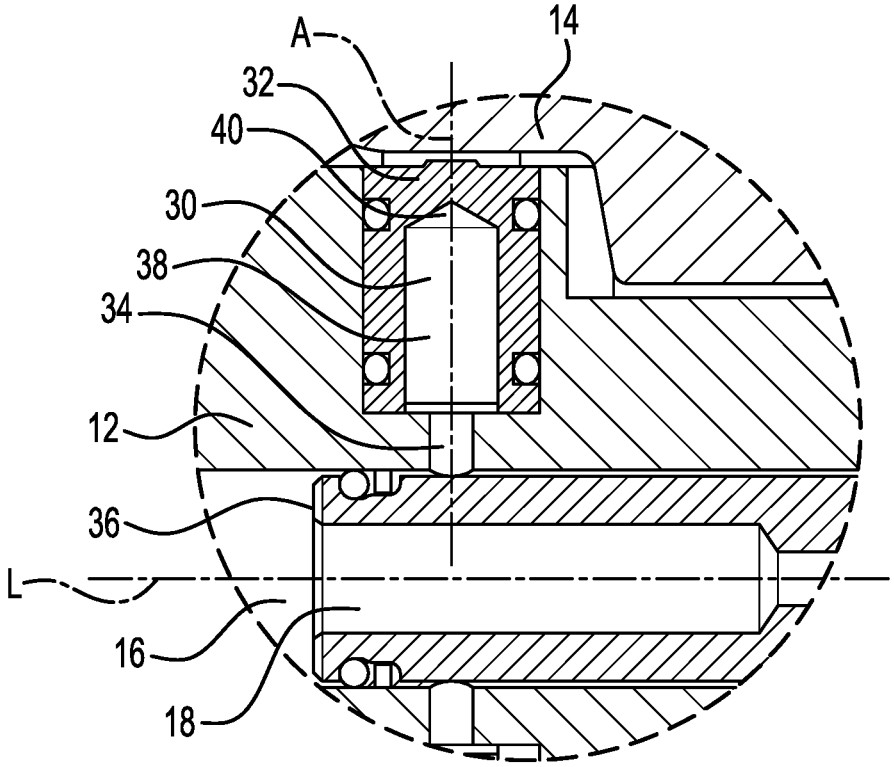
FIG. 6 shows a detailed view of one of the fin deployment pistons of FIG. 5.

Referring now to FIGS. 5 and 6, an exemplary embodiment of the projectile 10 is shown. The projectile 10 includes a tail base 12 that forms a rear end of the projectile 10 relative to a direction in which the projectile 10 is deployed from the gun. The projectile 10 may already have the base 12 attached to the projectile 10 when the projectile 10 is inserted into the cartridge case 7 (shown in FIG. 3). The base 12 may be cylindrical in shape and is formed of any suitable material. For example, a metal such as aluminum may be suitable. The base 12 disengages from the cartridge case 7 as part of the projectile 10 as the projectile 10 exits the cartridge case 7.

The projectile 10 includes a plurality of deployable fins 14 that are rotatably connected to the base 12. FIG. 5 shows the projectile 10 in a stowed state in which the fins 14 are in a folded position. The fins 14 remain in the folded position until the entire projectile 10 has exited the muzzle 4 of the gun 1 (shown in FIG. 1). When the projectile 10 is launched from the gun 1 to move from the stowed state to a flight state, the fins 14 are rotatable relative to the base 12 to move from the folded position to a deployed position in which the fins 14 extend radially outwardly from the base 12. The fins 14 remain in the deployed position during the flight state of the projectile 10.

Deployment of the projectile 10 is enabled by a pressure reservoir 16 arranged in the base 12. The pressure reservoir 16 may be formed integrally as part of the base 12. In other exemplary embodiments, the pressure reservoir 16 may be formed separately and removably inserted into the base 12. An ejection piston 18 is fluidly connected to the pressure reservoir 16. The ejection piston 18 may be arranged in the pressure reservoir 16 and movable through the pressure reservoir 16 when pressurized. When the projectile 10 is in the stowed state, the pressure reservoir 16 may be configured to retain gas. During deployment of the projectile 10 into the external environment, an external pressure source, such as the propellant 11*a*, 11*b*, 11*c* contained in the cartridge case 7 of the gun 1 (shown in FIG. 3) is actuated by the primer 9 to pressurize the pressure reservoir 16.

During deployment, the high pressure propellant gas flows through a flow control component 19 of the ejection piston 18 to fill the pressure reservoir 16. Any suitable flow control component may be used such as a restricting orifice or a check valve. The flow control component 19 may be arranged at an aft or forward end of the base 12. The aft end is in the aft or forward direction in which the projectile 10 travels. In an exemplary embodiment, an orifice may be removably inserted in the ejection piston 18. An orifice having a predetermined diameter may be selected for a particular application from a plurality of orifices having diameters with different sizes. An interchangeable orifice is advantageous in enabling further control of the pressure differential of the projectile 10 during deployment in different environments.

The pressure reservoir 16 may be filled with the high pressure gas before the projectile 10 exits the gun 1 (shown in FIG. 1). The pressure of the propellant gas may be 20 ksi or greater and the gas will flow through the flow control component 19 into the pressure reservoir 16 until the pressures are equal. Upon the projectile 10 exiting the muzzle 4 of the gun 1, the differential pressure between the pressurized pressure reservoir 16 and the external environment causes the ejection piston 18 to move away from the base 12 in the aft direction. In other words, the ejection piston 18 is axially translatable relative to the base 12. In other exemplary embodiments, instead of an external propellant, the pressurization of the pressure reservoir 16 may instead be formed by an explosive charge or any suitable ignitor contained in the pressure reservoir 16 itself.

The ejection piston 18 may include a retainer 20 that extends radially outwardly to engage the plurality of fins 14 when in the folded position prior to deployment of the projectile 10. The retainer 20 may be formed integrally with the ejection piston 18 as a single monolithic component, with the retainer 20 being formed at an aft end of the ejection piston 18. The retainer 20 includes a plurality of radially outer protrusions 22 or fingers that each are engageable within a corresponding notch 24 formed in the fin 14 when the fins 14 are in the folded position. The protrusions 22 may be formed as hooks or any other shape that is complementary to a contour of the notch 24. In an exemplary embodiment, the protrusions 22 may extend slightly axially toward the rear end of the base 12 such that the protrusions 22 hook into the fin 14 when the fin 14 is in the folded position.

The flow control component 19 of the ejection piston 18 may be formed in the retainer 20 at the aft end of the ejection piston 18. The retainer 20 may further include a stepped surface 26 that is formed radially outwardly relative to the flow control component 19 and a main body 28 of the ejection piston 18. The main body 28 may be cylindrical in shape such that the flow control component 19 is arranged along a longitudinal axis L of the main body 28. During movement of the ejection piston 18, the ejection piston 18 may move generally along the longitudinal axis L of the main body 28. The stepped surface 26 may engage against a corresponding aft surface of the base 12 when the fins 14 are in the folded position to position the retainer 20 relative to the base 12. During movement of the ejection piston 18, the protrusions 22 of the retainer 20 are disengaged from the notch 24 of the fins 14 and the fins 14 are able to rotate away from the ejection piston 18.

The projectile 10 includes a plurality of fin deployment pistons 30 that are actuated during movement of the ejection piston 18. A detailed view of the fin deployment pistons 30 are shown in FIG. 6. The fin deployment pistons 30 are housed in and supported for movement in radially extending chambers 32 formed in the base 12. The radially extending chambers 32 are fluidly connected to the pressure reservoir 16 via fin deployment piston ports 34 formed in the base 12. The radially extending chambers 32 and the fin deployment piston ports 34 may have any suitable shape, such as cylindrical, and any suitable dimensions. The fin deployment piston ports 34 have an outer diameter that is less than an outer diameter of the radially extending chambers 32 and an outer diameter of the pressure reservoir 16. Each radially extending chamber 32 may correspond to one fin deployment piston port 34. All of the fin deployment piston ports 34 extend radially outwardly from the pressure reservoir 16.

Any number of fin deployment pistons 30 may be provided and the number of fin deployment pistons 30 corresponds to the number of fins 14. The number of fins deployment piston ports 34 corresponds to the number of radially extending chambers 32 that house the fin deployment pistons 30. Each set containing one fin deployment piston 30, one radially extending chamber 32 and one fin deployment piston port 34 is arranged along an axis A which may be orthogonal or perpendicular to the longitudinal axis L of the ejection piston 18, as shown in FIG. 6. The fin deployment piston 30 is movable along the axis A toward the fin 14 when actuated. Each of the radially extending chamber 32 and the fin deployment piston port 34 may be elongated along the axis A. In other exemplary embodiments, the axis A may be angled or transverse relative to the longitudinal axis L such that the fin deployment piston 30 engage the corresponding fin 14 at an angle.

When the fins 14 are in the folded position shown in FIG. 5, the fin deployment piston ports 34 are closed by way of the ejection piston 18 being positioned to block fluid communication between the pressure reservoir 16 and the fin deployment piston ports 34. When the pressure reservoir 16 is pressurized and the ejection piston 18 is axially translated, the ejection piston 18 moves in the aft direction past the fin deployment piston ports 34. After a tail end 36 or rearmost end of the ejection piston 18 passes the fin deployment piston ports 34, fluid communication between the pressurized pressure reservoir 16 and the fin deployment piston ports 34 is enabled such that the fin deployment piston ports 34 are opened.

When the fin deployment piston ports 34 are opened, pressurized fluid flows from the pressure reservoir 16 into the radially extending chambers 32. The fin deployment pistons 30 are moved radially outwardly by the pressurized radially extending chamber 32 to engage the fins 14. In an exemplary embodiment, all of the fin deployment pistons 30 may be actuated simultaneously such that the movement of the fin deployment pistons 30 occurs simultaneously. In other exemplary embodiments, deployment of the fin deployment pistons 30 may be sequential, such that the fin deployment piston ports 34 may be formed to be offset relative to each other. For example, the fin deployment piston ports 34 may be arranged in a spiral pattern about the longitudinal axis L for opening at different times.

Using the fin deployment pistons 30 is advantageous in that the fin deployment pistons 30 are actuated using the same pressurized fluid that actuates the ejection piston 18. The fin deployment pistons 30 are also able to provide the requisite force against the fins 14 to ensure movement of the fins 14 out of the folded position. Accordingly, additional actuation mechanisms or linkages, such as springs, are not needed to deploy the fins 14.

Each of the fin deployment pistons 30 may be formed to have any suitable shape and dimensions. The fin deployment pistons 30 and the ejection piston 18 may have a shuttle-valve type arrangement in which the ejection piston 18 is shifted to open the fin deployment piston ports 34. In an exemplary embodiment, the fin deployment pistons 30 may have a cylindrical body 38 with a tapered nose 40 at a radially outermost end opposite the fin deployment piston ports 34. The tapered nose 40 may directly engage the fin 14.

The fin deployment pistons 30 may be formed to maintain contact with the fins 14 for a predetermined amount of rotation of the fins 14. The predetermined amount of rotation may be a full amount of rotation or less than a full amount of rotation. The fin deployment pistons 30 may be arranged to engage the fins 14 at a predetermined point along the surface of the fins 14 as dependent on the application. In an exemplary embodiment, the fin deployment pistons 30 may be arranged to engage the fins 14 at a point that is closer to the rear end of the fins 14 as compared with the aft end when the fins 14 are in the folded position. In still other exemplary embodiments, more than one fin deployment piston 30 may be provided per fin 14, such that the fin deployment pistons 30 engage the fin 14 at multiple locations.

When reaching a deployed position, the fins 14 are locked to prevent backwards rotation of the fins 14 toward the folded position. After a predetermined amount of rotation of the fins 14 by the fin deployment pistons 30, spring-biased locking pins 42 are arranged to engage the fins 14. The fins 14 and the locking pins 42 may be configured to enable the fins 14 to rotate further past an initial deployed position into a final deployed position, which is also referred to as an overrotation of the fins 14. The overrotation may be between one and five degrees. The fin deployment pistons 30 are configured to exert enough force against the fins 14 that ensures that the fins 14 are in a deployed position before the ejection piston 18 is able to eject from the assembly. The ejection piston 18 including the retainer 20 may then be ejected from the assembly to reduce the weight of the projectile 10 during travel. In alternative embodiments, the ejection piston 18 and the retainer 20 may remain attached to the projectile 10 by any suitable linkage after ejection.

The fins 14 each may be formed to have any suitable shape. All of the fins 14 may be the same in shape and size. Any number of fins 14 may be provided and the number of fins 14 may be dependent on the application. For example, between four and eight fins may be suitable. More than eight fins may also be suitable for particular applications. The fins 14 may have an elongated body that extends in the forward direction from the base 12 when in the folded position. A length of the fins 14 in the forward direction is longer than a width of the fins 14. The thickness of the fins 14 is less than the length and the width. Any suitable material may be used to form the fins. For example, a metal material such as steel may be suitable. When in the folded position, the fins 14 may extend parallel to the longitudinal axis L of the pressure reservoir 16 and the ejection piston 18. The longitudinal axis L may also define the forward and rear direction of travel of the projectile 10.

The fins 14 are also formed to have an engagement surface for the locking pins 42. In an exemplary embodiment, an indent or notch 44 may be formed along a peripheral surface of each fin 14 for receiving a corresponding locking pin 42. The notch 44 may be formed proximate a pivot axis 46 of the fin 14 that is arranged at the rear end of the fin 14. The notch 44 may be formed at a rearmost end of the fin 14. Any suitable support device may be used to form the pivot axis 46 between the fin 14 and the base 12. For example, a pin may form the pivot axis 46. The notch 44 may be shaped to accommodate a head 48 of the locking pin 42 and to also enable pivoting movement of the locking pin 42 within the notch 44 during overrotation of the fin 14. The notch 44 may have any suitable shape for capturing the locking pin 42. A rectangular cutout or a curved rectangular cutout shape having a sharp corner may be suitable to ensure a locking surface between the locking pin 42 and the fin 14.

A continuous curved contour 50 of the fin 14 may extend between the notch 44 and a fin surface 52 against which the deployment fin piston 30 engages when actuated. The fin surface 52 may be planar rather than curved. The locking pin 42 may be engageable along the curved contour 50 until the locking pin 42 is received and seated in the notch 44. When the fin 14 is in the folded position, the head 48 of the locking pin 42 may be biased against the curved contour 50 by a biasing spring 54 that is supported in the base 12 and configured to bias the locking pin 42 toward the fin 14. One end of the biasing spring 54 engages against the base 12 and the opposite end of the biasing spring 54 engages the locking pin 42 which engages the fin 14. The base 12 may define a radially extending slot 56 that opens to the rear end of the fin 14 and supports the biasing spring 54 and the locking pin 42 for movement relative to the rear end of the fin 14. The slot 56 may extend perpendicular relative to the longitudinal axis L of the projectile 10 such that the locking pin 42 is confined to movement in the perpendicular direction.

Figure 7:
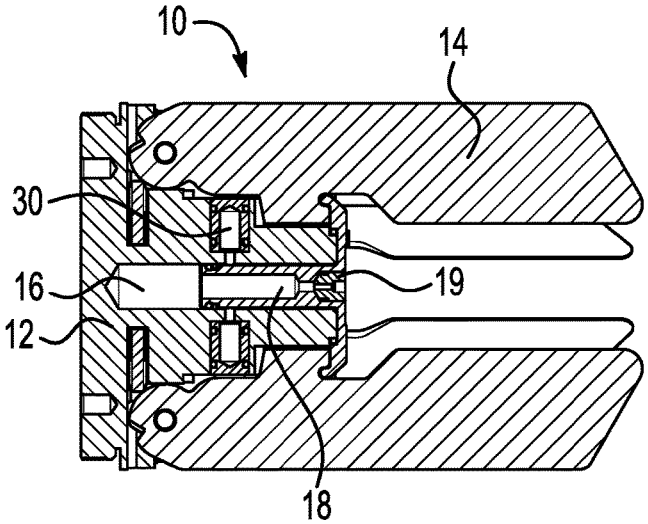
FIG. 7 shows the projectile of FIG. 5 in an initial position.

Referring now to FIGS. 7-13, an exemplary operation of the projectile 10 including the fin deployment pistons 30 is shown. FIG. 7 corresponds to FIG. 5 and shows an initial position of the projectile 10 in which the fins 14 are in the folded position relative to the base 12. In the initial position, the ejection piston 18 is supported in the pressure reservoir 16. When in the initial position, the gun may be activated such that, as shown in FIG. 1, high pressure gas fills the cartridge case 7 and pushes the projectile 10 from the chamber 5 into the bore 3 of the gun 1. The high pressure gas enters the pressure reservoir 16 via the flow control component 19 such that pressure in the pressure reservoir 16 increases. In an exemplary application, the gun pressure may be around 28 ksi.

Figure 8:
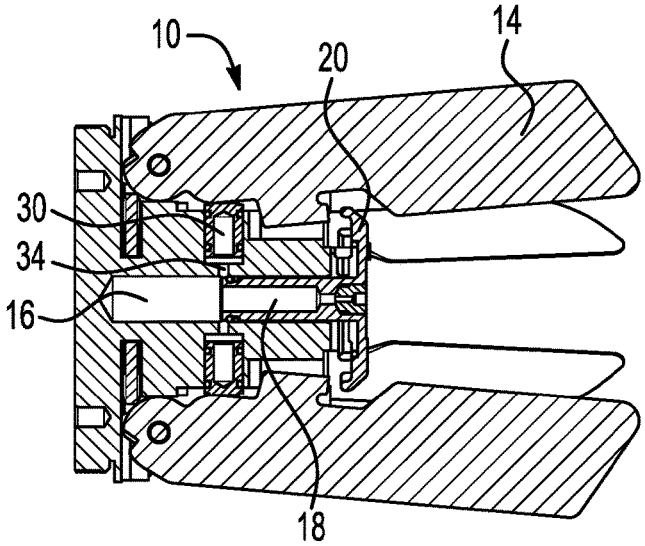
FIG. 8 shows the projectile of FIG. 7 when the pressure reservoir of the projectile is pressurized and fin deployment piston ports are partially opened.

The high pressure gas will flow into the pressure reservoir 16 until the pressures are equal. Upon a muzzle exit by the projectile 10, the differential pressure between the high pressure in the pressure reservoir versus a low ambient pressure of the external environment outside the gun 1 causes movement of the ejection piston 18. For example, the pressure in the pressure reservoir 16 may be around 20 ksi or greater and the gun pressure may be zero. As shown in FIG. 8, the ejection piston 18 starts to move in the aft direction through the pressure reservoir 16 such that the retainer 20 of the ejection piston 18 disengages from the fins 14. The ejection piston 18 is moving past the fin deployment piston port 34, such that the fin deployment piston port 34 is partially opened in FIG. 8.

Figure 9:
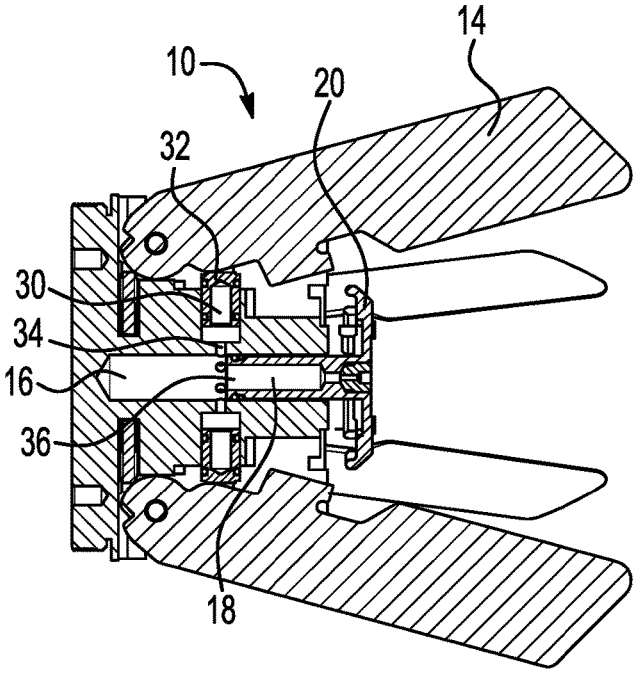
FIG. 9 shows the projectile of FIG. 7 with the fin deployment piston ports being fully opened.
Figure 10:
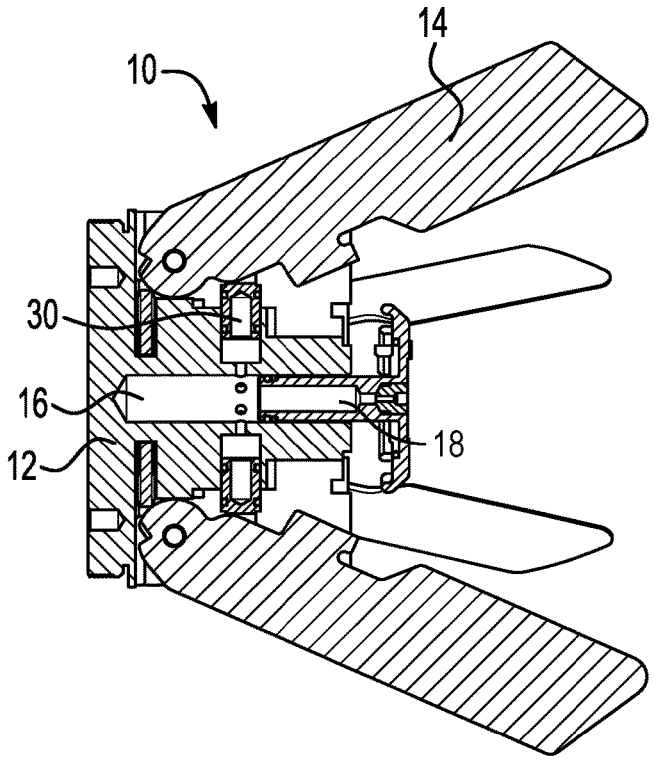
FIG. 10 shows the projectile of FIG. 7 with the fins moved out of the folded position toward the deployed position.
Figure 11:
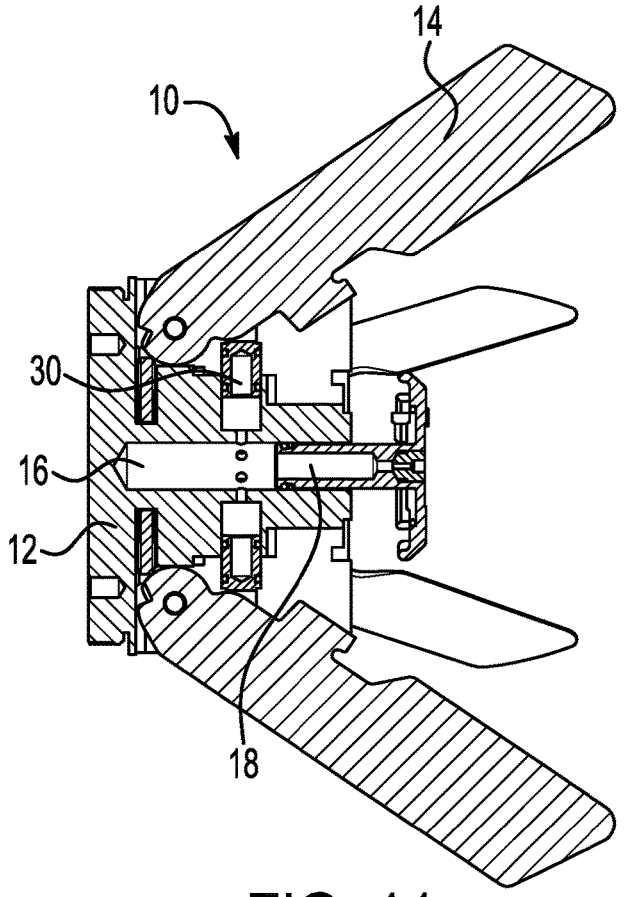
FIG. 11 shows the projectile of FIG. 7 with the fins moved farther out of the folded position and the ejection piston moved farther in an aft direction as compared with FIG. 10.
Figure 12:
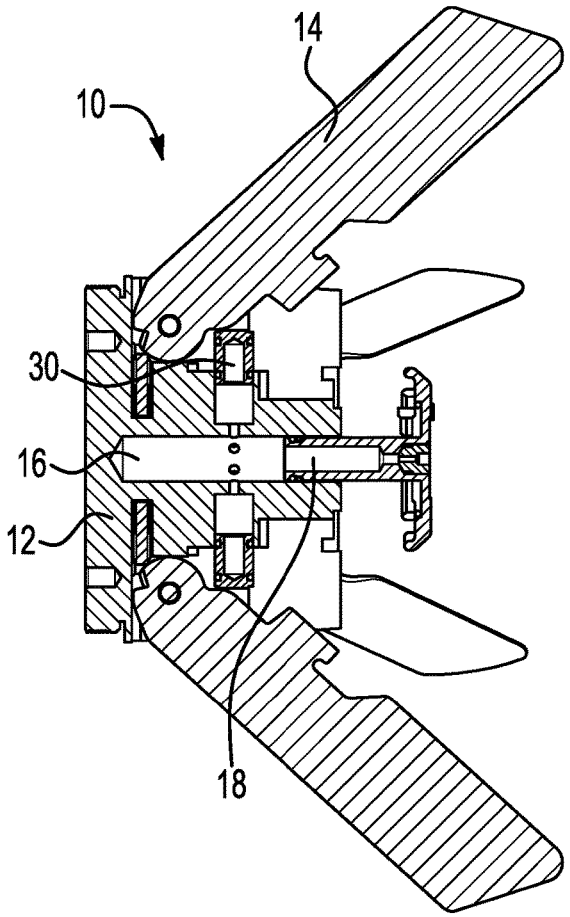
FIG. 12 shows the projectile of FIG. 7 with the fins moved farther out of the folded position and the ejection piston moved farther in an aft direction as compared with FIG. 11.

FIG. 9 shows the fin deployment piston port 34 fully opened after the tail end 36 of the ejection piston 18 is moved past the fin deployment piston port 34. The radially extending chamber 32 is then in fluid communication with the pressure reservoir 16. The radially extending chamber 32 is thus pressurized to move the fin deployment pistons 30 toward the fins 14. The fin deployment pistons 30 are then moved by the pressurization to push against the fins 14 in a radially outwardly direction.

FIGS. 10-13 show the deployment of the projectile 10 as the ejection piston 18 continues to move in the aft direction through the pressure reservoir 16. The fins 14 continue to rotate relative to the base 12. The fin deployment pistons 30 may be configured to continuously engage the fins 14 during the deployment sequence or the fin deployment pistons 30 may only engage the fins 14 for a portion of the deployment sequence. For example, the fin deployment pistons 30 may only be used to engage the fins 14 during the initial deployment of the fins 14.

Figure 13:
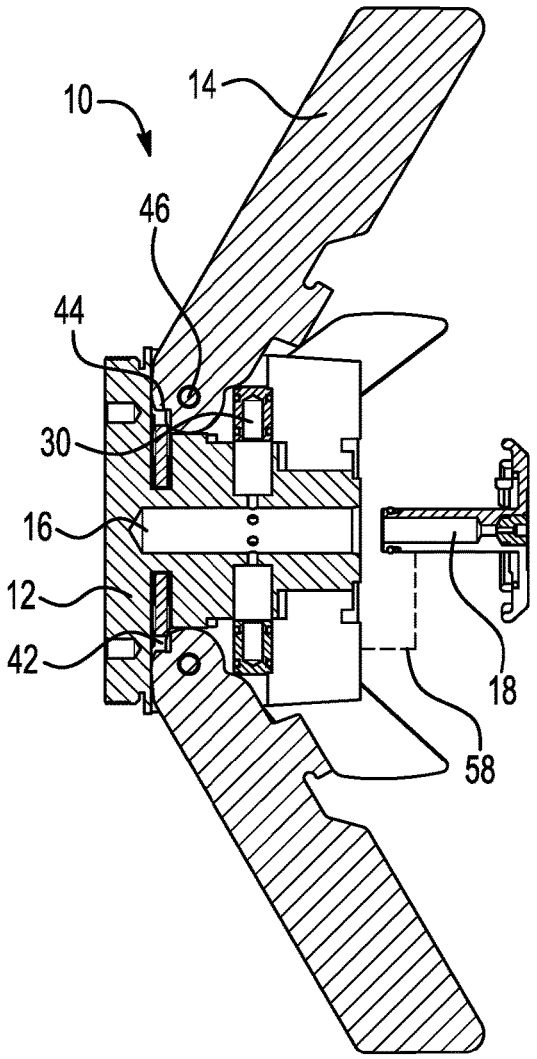
FIG. 13 shows the projectile of FIG. 7 in a deployed position in which locking pins engage the fins.

FIG. 13 shows an initial deployed position of the fins 14. When the fins 14 reach the initial deployed position, the locking pins 42 are engaged in the notches 44 of the fins 14 such that the fins 14 are prevented from moving back toward the folded position. The ejection piston 18 is then ejected from the assembly. Accordingly, deployment of the fins 14 is ensured prior to ejection of the ejection piston 18. FIG. 13 shows the ejection piston 18 being discarded from the projectile 10 after ejection. In other exemplary embodiments, the ejected ejection piston 18 may be retained in the base 12 or other components of the projectile assembly by any suitable linkage 58, as schematically shown in FIG. 13.

The engagement between the notch 44 and the locking pins 42 may enable overrotation of the fins 14 past the initial deployed position shown in FIG. 13. For example, the fins 14 may be rotatable in a rotational direction, either clockwise or counterclockwise, about the pivot axis 46 starting from the folded position. After the fin deployment pistons 30 have pushed the fins 14 to rotate a predetermined number of degrees, such that the fins 14 have a first rotational range, the fins 14 reach the initial deployed position in which the locking pin 42 first engages in the notch 44.

The fin deployment pistons 30 are configured to move the fins 14 through the entire first rotational range, either by impacting the fins 14 with a large enough pushing force, or by maintaining continuous contact with the fins 14. In contrast, in a conventional projectile which uses springs that engage the fin 14, the fin 14 may stop rotating between 20 and 25 degrees such that the fin would never reach the deployed position and deployment would fail. The projectile 10 may be formed to enable any first rotational range for the fins 14. For example, the first rotational range may be approximately 60 degrees. Other first rotational ranges are suitable, such that the fins 14 may rotate fewer than 60 degrees or more than 60 degrees to reach the initial deployed position shown in FIG. 13. After reaching the initial deployed position, the fins 14 may have a second rotational range in which the fin 14 continues to rotate toward the fully deployed position, by way of the aerodynamic drag acting on the fins 14.

Figure 14:
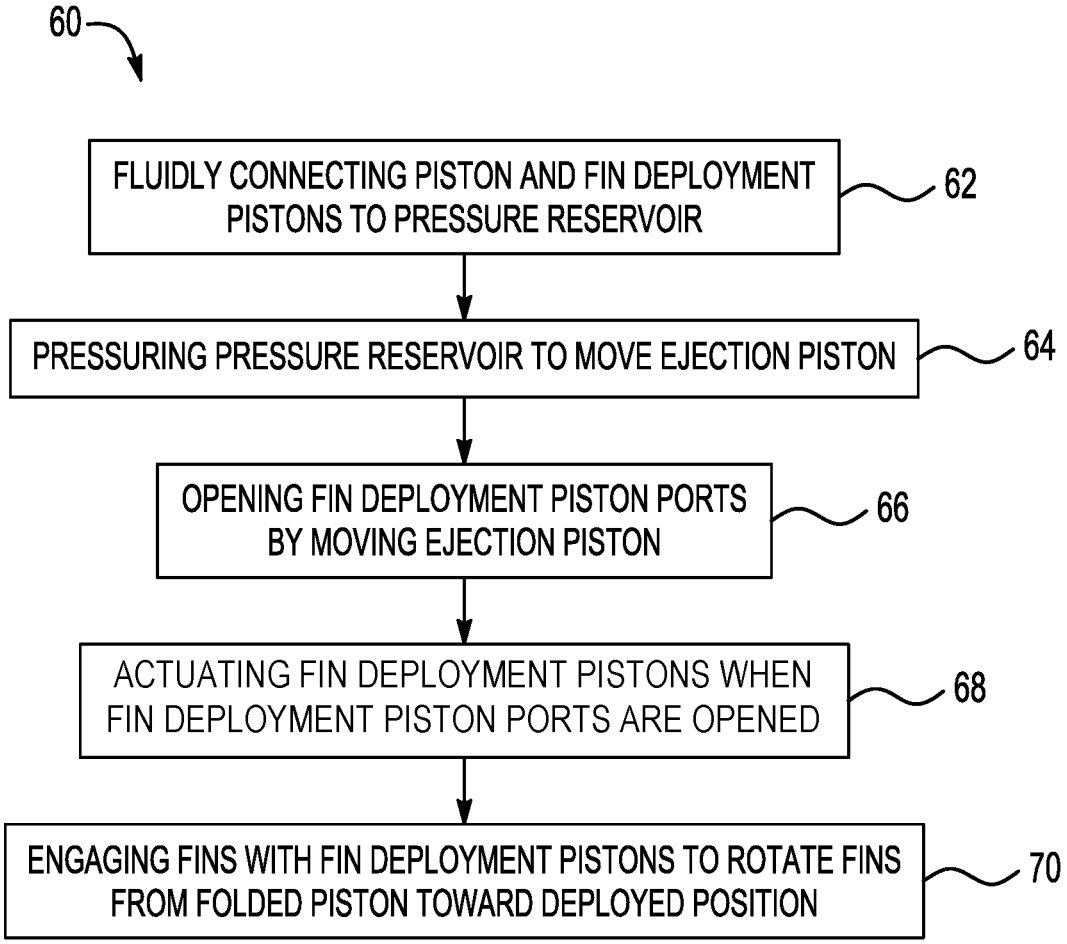
FIG. 14 shows a flowchart for a method of deploying a projectile such as the projectile of FIG. 5.

Referring now to FIG. 14, a flowchart showing a method 60 of deploying a projectile, such as the projectile 10 shown in FIGS. 5-13 and described herein. Step 62 of the method 60 includes fluidly connecting the ejection piston 18 and the plurality of fin deployment pistons 30 to the pressure reservoir 16. Step 64 of the method 60 includes pressurizing the pressure reservoir 16 to move the ejection piston 18. Step 64 may include selecting an orifice from a plurality of piston orifices having different sizes and inserting the orifice into the front end of the ejection piston 18. The components of the projectile 10 including the base 12, the pressure reservoir 16, the ejection piston 18, the fin deployment pistons 30, the locking pins 42, and the fins 14 may be formed using any suitable manufacturing processes, such as additive manufacturing processes, conventional manufacturing processes, or a combination thereof.

Step 66 of the method 60 includes opening the fin deployment piston ports 34 by moving the ejection piston 18 and step 68 includes actuating the fin deployment pistons 30 when the fin deployment piston ports 34 are opened. Step 70 of the method 60 includes engaging the fins 14 with the fin deployment pistons 30 to rotate the fins 14 from the folded position toward the deployed position. Step 66 may further include locking the fins 14 in the deployed position, such as by locking pins 42. Prior to deploying the fins 14, the fins 14 may be retained in the folded position using the retainer 20 on the ejection piston 18.

The projectile and method of deploying the projectile described herein enables successful deployment of any suitable projectile regardless of the external environment. In contrast to conventional projectiles, the projectile described herein ensures movement of the fins using the fin deployment pistons, without requiring additional components such as a spring. In an exemplary application, the projectile may be suitable for gun environments having a muzzle velocity that is between 400 and 700 meters per second, a base pressure that is between 16 and 28 ksi, and setback accelerations between 6,000 and 10,000 g's. Many other gun environments may be suitable.

The configuration of the engaging surfaces between the fin deployment pistons and the fins provides a same effect as a mechanical linkage without providing a mechanical linkage that would require small precision machined parts that may not be able to be made strong enough for particular applications. The interface between the fin deployment pistons and the fins ensures that the fins rotate into the locked position before the ejection piston is ejected from the projectile assembly. If debris or other friction increasing contaminants impede deployment, the pressurized fin deployment pistons may continue to push the fins until the internal gas pressure has bled off or the fins are deployed.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A projectile comprising:

a base;

a pressure reservoir connected to the base;

a plurality of fins rotatably connected to the base and movable from a folded position to a deployed position;

a plurality of fin deployment pistons fluidly connected to the pressure reservoir and engageable with the plurality of fin deployment pistons to move the fins toward the deployed position; and an ejection piston fluidly connected to the pressure reservoir and configured to open fluid communication between the plurality of fin deployment pistons and the pressure reservoir when the pressure reservoir is pressurized.

2. The projectile according to claim 1, wherein the ejection piston is configured for axial translation through the pressure reservoir when the pressure reservoir is pressurized.

3. The projectile according to claim 1, wherein the base includes a plurality of radially extending chambers, each of the plurality of radially extending ports housing one of the plurality of fin deployment pistons.

4. The projectile according to claim 3, wherein the base includes a plurality of fin deployment piston ports connected between the pressure reservoir and the plurality of radially extending chambers.

5. The projectile according to claim 4, wherein the ejection piston is movable from an initial position in which the ejection piston blocks the plurality of fin deployment piston ports to a deployment position in which the ejection piston is moved past the plurality of fin deployment piston ports to open the plurality of fin deployment piston ports.

6. The projectile according to claim 1, wherein the ejection piston includes a retainer that extends radially outwardly to hold the plurality of fins in the folded position.

7. The projectile according to claim 6, wherein the retainer is arranged aft relative to the plurality of fin deployment pistons when the plurality of fins are in the folded position.

8. The projectile according to claim 6, wherein each of the plurality of fins includes a notch that receives a protrusion of the retainer when the plurality of fins are in the folded position.

9. The projectile according to claim 1, wherein the ejection piston remains attached to the base after the plurality of fins are in the deployed position.

10. The projectile according to claim 1 further comprising a plurality of locking pins that are supported in the base and configured to engage the plurality of fins when the plurality of fins are in the deployed position.

11. The projectile according to claim 10, wherein the plurality of fin deployment pistons are arranged aft relative to the plurality of locking pins.

12. The projectile according to claim 1, wherein the plurality of fin deployment pistons are arranged to move in a direction that is orthogonal to a direction in which the ejection piston moves.

13. The projectile according to claim 1, wherein each of the plurality of fin deployment pistons has a tapered nose that contacts one of the plurality of fins.

14. The projectile according to claim 1, wherein the ejection piston includes a flow control component arranged at an aft end of the base.

15. The projectile according to claim 1 comprising a propellant and a primer that are arranged externally to the projectile and configured to pressurize the pressure reservoir.

16. The projectile according to claim 1, wherein each of the plurality of fin deployment pistons is configured to engage only one of the plurality of fins.

17. A gun-launched projectile assembly comprising:

a barrel;

a cartridge that is arranged in the barrel and contains a propellant and a primer; and a projectile releasably arranged in the cartridge, wherein the projectile includes a base, a pressure reservoir connected to the base, a plurality of fins rotatably connected to the base and movable from a folded position to a deployed position, a plurality of fin deployment pistons fluidly connected to the pressure reservoir and engageable with the plurality of fin deployment pistons to move the fins toward the deployed position, and an ejection piston fluidly connected to the pressure reservoir and configured to open fluid communication between the plurality of fin deployment pistons and the pressure reservoir when the pressure reservoir is pressurized.

18. A method of deploying a projectile, the method comprising:

fluidly connecting an ejection piston and a plurality of fin deployment pistons to a pressure reservoir;

pressurizing the pressure reservoir to move the ejection piston;

opening a plurality of fin deployment piston ports that are fluidly connected with the pressure reservoir by movement of the ejection piston;

actuating the plurality of fin deployment pistons when the fin deployment piston ports are opened; and engaging a plurality of fins with the plurality of fin deployment pistons to rotate the plurality of fins from a folded position toward a deployed position.

19. The method according to claim 18 further comprising locking the plurality of fins in the deployed position.

20. The method according to claim 18 further comprising retaining the plurality of fins in the folded position using a retainer formed on the ejection piston.

* * * * *